US007677236B2

(12) United States Patent
Deng

(10) Patent No.: US 7,677,236 B2
(45) Date of Patent: Mar. 16, 2010

(54) HEATER CONFIGURED TO OPERATE WITH A FIRST OR SECOND FUEL

(76) Inventor: David Deng, 2668 Highridge Dr., Chino Hills, CA (US) 91709

( * ) Notice: Subject to any disclaimer, the term of this patent is extended or adjusted under 35 U.S.C. 154(b) by 581 days.

(21) Appl. No.: 11/443,446

(22) Filed: May 30, 2006

(65) Prior Publication Data

US 2007/0277813 A1 Dec. 6, 2007

Related U.S. Application Data

(60) Provisional application No. 60/801,586, filed on May 17, 2006, provisional application No. 60/801,585, filed on May 17, 2006, provisional application No. 60/801,587, filed on May 17, 2006, provisional application No. 60/801,783, filed on May 19, 2006.

(51) Int. Cl.
*F24C 3/00* (2006.01)
*F23Q 9/00* (2006.01)

(52) U.S. Cl. ..... 126/92 R; 126/92 AC; 431/278; 431/280; 431/284; 431/76

(58) Field of Classification Search ..... 431/9, 431/182, 183, 74, 76, 278, 280, 281, 284; 231/401, 403, 404, 11, 105, 406, 8, 472, 231/487, 489, 501; 126/92 R, 92 AC; 239/401, 239/403, 404, 440, 11, 105, 406, 8, 472, 239/487, 489, 501; 137/599.09, 505.14, 137/505.41

See application file for complete search history.

(56) References Cited

U.S. PATENT DOCUMENTS 1,639,780 A 8/1927 Mulholland
2,380,956 A 8/1945 Evarts
2,630,821 A 3/1953 Arey et al.
2,687,140 A 8/1954 St. Clair et al.
3,001,541 A 9/1961 St. Clair et al.

(Continued)

FOREIGN PATENT DOCUMENTS

DE 720 854 C 5/1942

(Continued)

OTHER PUBLICATIONS

International Search Report and Written Opinion for Application No. PCT-US2008-056910 mailed Jul. 16, 2008.

(Continued)

*Primary Examiner*—Alfred Basichas
(74) *Attorney, Agent, or Firm*—Knobbe, Martens, Olson & Bear, LLP

(57) ABSTRACT

Certain embodiments of a nozzle are configured to dispense a first gas, liquid, or combination thereof at a first pressure in a first mode of operation and dispense a second gas, liquid, or combination thereof at a second pressure in a second mode of operation. In some embodiments, the nozzle is integrated in a heat-producing device, such as, for example, a heater, a fireplace, or a stove. In some embodiments, the heat-producing device including the nozzle can operate with a first combustible fuel at a first pressure, or alternatively, can operate with a second combustible fuel at a second pressure. In some embodiments, the nozzle is used in applications other than heat-producing devices.

13 Claims, 14 Drawing Sheets

U.S. PATENT DOCUMENTS

| | | | | | |
|---|---|---|---|---|---|
| 3,139,879 | A | | 7/1964 | Bauer et al. | |
| 3,331,392 | A | | 7/1967 | Davidson et al. | |
| 3,590,806 | A | | 7/1971 | Locke | |
| 3,814,573 | A | | 6/1974 | Karlovetz | |
| D243,694 | S | | 3/1977 | Faulkner | |
| 4,290,450 | A | | 9/1981 | Swanson | |
| 4,340,362 | A | | 7/1982 | Chalupsky et al. | |
| 4,348,172 | A | | 9/1982 | Miller | |
| 4,640,680 | A | | 2/1987 | Schilling | |
| 4,718,846 | A | | 1/1988 | Oguri et al. | |
| 4,768,543 | A | | 9/1988 | Wienke et al. | |
| 4,848,313 | A | | 7/1989 | Velie | |
| 4,930,538 | A | | 6/1990 | Browne | |
| 4,965,707 | A | | 10/1990 | Butterfield | |
| 5,090,899 | A | | 2/1992 | Kee | |
| 5,172,728 | A | | 12/1992 | Tsukazaki | |
| 5,239,979 | A | | 8/1993 | Maurice et al. | |
| 5,251,823 | A | * | 10/1993 | Joshi et al. | 239/401 |
| 5,413,141 | A | | 5/1995 | Dietiker | |
| 5,470,018 | A | | 11/1995 | Smith | |
| 5,513,798 | A | * | 5/1996 | Tavor | 239/8 |
| 5,542,609 | A | | 8/1996 | Myers et al. | |
| 5,567,141 | A | * | 10/1996 | Joshi et al. | 431/8 |
| 5,584,680 | A | | 12/1996 | Kim | |
| 5,603,211 | A | * | 2/1997 | Graves | 60/776 |
| 5,642,580 | A | | 7/1997 | Hess et al. | |
| 5,645,043 | A | | 7/1997 | Long et al. | |
| D391,345 | S | | 2/1998 | Mandir et al. | |
| 5,782,626 | A | * | 7/1998 | Joos et al. | 431/8 |
| 5,814,121 | A | * | 9/1998 | Travis | 65/346 |
| 5,838,243 | A | | 11/1998 | Gallo | |
| 5,915,952 | A | | 6/1999 | Manning et al. | |
| 5,941,699 | A | | 8/1999 | Abele | |
| 5,966,937 | A | * | 10/1999 | Graves | 60/748 |
| 5,975,112 | A | | 11/1999 | Ohmi et al. | |
| 5,987,889 | A | * | 11/1999 | Graves et al. | 60/748 |
| 5,988,204 | A | | 11/1999 | Reinhardt et al. | |
| 6,035,893 | A | | 3/2000 | Ohmi et al. | |
| 6,045,058 | A | * | 4/2000 | Dobbeling et al. | 239/11 |
| 6,076,517 | A | | 6/2000 | Kahlke et al. | |
| 6,227,451 | B1 | | 5/2001 | Caruso | |
| 6,244,524 | B1 | * | 6/2001 | Tackels et al. | 239/403 |
| 6,257,270 | B1 | | 7/2001 | Ohmi et al. | |
| 6,340,298 | B1 | | 1/2002 | Vandrak et al. | |
| 6,354,072 | B1 | * | 3/2002 | Hura | 60/776 |
| 6,543,235 | B1 | * | 4/2003 | Crocker et al. | 60/776 |
| 6,648,635 | B2 | | 11/2003 | Vandrak et al. | |
| 6,884,065 | B2 | | 4/2005 | Vandrak et al. | |
| 6,904,873 | B1 | | 6/2005 | Ashton | |
| 6,938,634 | B2 | | 9/2005 | Dewey | |
| 7,044,729 | B2 | | 5/2006 | Ayastuy | |
| 7,251,940 | B2 | * | 8/2007 | Graves et al. | 60/742 |
| 7,434,447 | B2 | | 10/2008 | Deng | |
| 2002/0058266 | A1 | | 5/2002 | Clough et al. | |
| 2004/0238030 | A1 | | 12/2004 | Dewey, Jr. | |

FOREIGN PATENT DOCUMENTS

| | | | |
|---|---|---|---|
| JP | 58 219320 | A | 12/1983 |
| JP | 03 230015 | A | 10/1991 |
| JP | 2003 056845 | A | 2/2003 |
| JP | 2003 074837 | A | 3/2003 |
| JP | 2003 074838 | A | 3/2003 |

OTHER PUBLICATIONS

Heat and Glo, Escape-42DV Owner's Manual, Rev. i, Dec. 2006.
Heat and Glo, Escape Series Gas Fireplaces, Mar. 2005.
Napoleon, Park Avenue Installation and Operation Instructions, Jul. 20, 2006.
Napoleon, The Madison Installation and Operation Instructions, May 24, 2005.
Consumer Guide to Vent-Free Gas Supplemental Heating Products, est. 2007, p. 10-11.

* cited by examiner

HEATER CONFIGURED TO OPERATE WITH A FIRST OR SECOND FUEL

CROSS-REFERENCE TO RELATED APPLICATIONS

This application claims the benefit under 35 U.S.C. § 119 (e) of U.S. Provisional Application No. 60/801,586, filed May 17, 2006, titled PRESSURE REGULATOR; U.S. Provisional Application No. 60/801,585, filed May 17, 2006, titled NOZZLE; U.S. Provisional Application No. 60/801,587, filed May 17, 2006, titled OXYGEN DEPLETION SENSOR; and U.S. Provisional Application No. 60/801,783, filed May 19, 2006, titled HEATER, the entire contents of each of which are hereby incorporated by reference herein and made a part of this specification.

BACKGROUND

1. Field of the Inventions

Certain embodiments disclosed herein relate generally to nozzles, and relate more specifically to nozzles for dispensing a gas, liquid, or combination thereof.

2. Description of the Related Art

Nozzles are used in a variety of applications, including heat-producing devices. In particular, nozzles are used in many varieties of heaters, fireplaces, stoves, and other heat-producing devices which utilize pressurized, combustible fuels. Some such devices operate with liquid propane, while others operate with natural gas. However, nozzles, such devices, and certain other components thereof have various limitations and disadvantages.

SUMMARY OF THE INVENTIONS

In certain embodiments, an apparatus comprises a nozzle for selectively dispensing a first gas, liquid, or combination thereof or a second gas, liquid, or combination thereof. In some embodiments, the nozzle comprises a first inlet and a second inlet. The nozzle further comprises a first outlet configured to dispense the first gas, liquid, or combination thereof at a first pressure and a second outlet configured to dispense the second gas, liquid or combination thereof at a second pressure. The nozzle further comprises a first cavity in fluid communication with the first inlet and the first outlet and a second cavity in fluid communication with the second inlet and the second outlet. The second cavity is at least partially within the first cavity in some embodiments. In further embodiments, the first inlet defines a first inlet area and the first outlet defines a first outlet area such that the first inlet area is larger than the first outlet area. In further embodiments, the second inlet defines a second inlet area and the second outlet defines a second outlet area such that the second inlet area is larger than the second outlet area. In further embodiments, in a first operating mode, the first gas, liquid, or combination thereof enters the nozzle through the first inlet and proceeds through the first outlet to exit the nozzle, and in a second operating mode, the second gas, liquid, or combination thereof enters the nozzle through the second inlet and proceeds through the second outlet to exit the nozzle.

In other embodiments, an apparatus comprises a nozzle for delivering a first gas, liquid, or combination thereof in a first mode or a second gas, liquid, or combination thereof in a second mode. In certain embodiments, the nozzle comprises a first tube defining a first input aperture, a first output aperture, and a first pressure chamber therebetween. The first pressure chamber decreases in area toward the first output aperture, in some embodiments. In certain embodiments, a second tube is at least partially within the first tube, and the second tube defines a second input aperture, a second output aperture, and a second pressure chamber therebetween. In certain embodiments, the second pressure chamber decreases in area toward the second output aperture. The first tube can be configured to deliver the first gas, liquid, or combination thereof through the first output aperture and the second tube can be configured to deliver the second gas, liquid, or combination thereof through the second output aperture.

In certain embodiments, an apparatus for dispensing fluid from a first source in a first mode of operation and for dispensing fluid from a second source in a second mode of operation comprises an inner sidewall with a first passage therethrough and an outer sidewall with a second passage therethrough. In some embodiments, the second passage has an inner boundary, at least a portion of which is defined by an outer surface of the inner sidewall, and an outer boundary, at least a portion thereof defined by an inner surface of the outer sidewall. In certain embodiments, the apparatus further comprises a first input at a proximal end of the inner sidewall, the first input being configured to allow fluid from the first source to enter the first passage and a second input through the outer sidewall, the second input being configured to allow fluid from the second source to enter the second passage. In certain embodiments, the apparatus further comprises a first opening at a distal end of the inner sidewall, the first opening being sized and configured to dispense fluid at a first pressure, and a second opening at a distal end of the outer sidewall, the second opening being sized and configured to dispense fluid at a second pressure.

In certain embodiments, a heater configured to operate with either a first gas, liquid, or combination thereof at a first pressure or a second gas, liquid, or combination thereof at a second pressure comprising a first pipe defining a passageway for the first gas, liquid, or combination thereof, a second pipe defining a passageway for the second gas, liquid, or combination thereof; and a nozzle. In certain embodiments, the nozzle comprises a first cavity in fluid communication with the first pipe, the first cavity having an input end configured to couple with the first pipe and an output end configured to dispense the first gas, liquid, or combination thereof at the first pressure. In some embodiments, the first cavity decreases in size toward the output end thereof. In certain embodiments, the nozzle further comprises a second cavity in fluid communication with the second pipe, the second cavity having an input end configured to couple with the second pipe and an output end configured to dispense the second gas, liquid, or combination thereof at the second pressure. In some embodiments, the second cavity decreases in size toward the output end thereof.

BRIEF DESCRIPTION OF THE DRAWINGS

Various embodiments are depicted in the accompanying drawings for illustrative purposes, and should in no way be interpreted as limiting the scope of the inventions.

DETAILED DESCRIPTION OF THE PREFERRED EMBODIMENTS

Many varieties of space heaters, fireplaces, stoves, fireplace inserts, gas logs, and other heat-producing devices employ combustible fuels, such as liquid propane and natural gas. These devices generally are designed to operate with a single fuel type at a specific pressure. For example, as one having skill in the art would appreciate, some gas heaters that are configured to be installed on a wall or a floor operate with natural gas at a pressure in a range from about 3 inches of water column to about 6 inches of water column, while others operate with liquid propane at a pressure in a range from about 8 inches of water column to about 12 inches of water column.

In many instances, the operability of such devices with only a single fuel source is disadvantageous for distributors, retailers, and/or consumers. For example, retail stores often try to predict the demand for natural gas units versus liquid propane units over a given winter season, and accordingly stock their shelves and/or warehouses with a percentage of each variety of heating unit. Should such predictions prove incorrect, stores can be left with unsold units when the demand for one type of heater was less than expected, while some potential customers can be left waiting through shipping delays or even be turned away empty-handed when the demand for one type of heater was greater than expected. Either case can result in financial and other costs to the stores. Additionally, some consumers can be disappointed to discover that the styles or models of stoves or fireplaces with which they wish to improve their homes are incompatible with the fuel sources with which their homes are serviced.

Certain advantageous embodiments disclosed herein reduce or eliminate these and other problems associated with heating devices that operate with only a single type of fuel source. Furthermore, although the embodiments described hereafter are presented in the context of vent-free heating systems, the apparatus and devices disclosed and enabled herein can benefit a wide variety of other applications.

Figure 1:
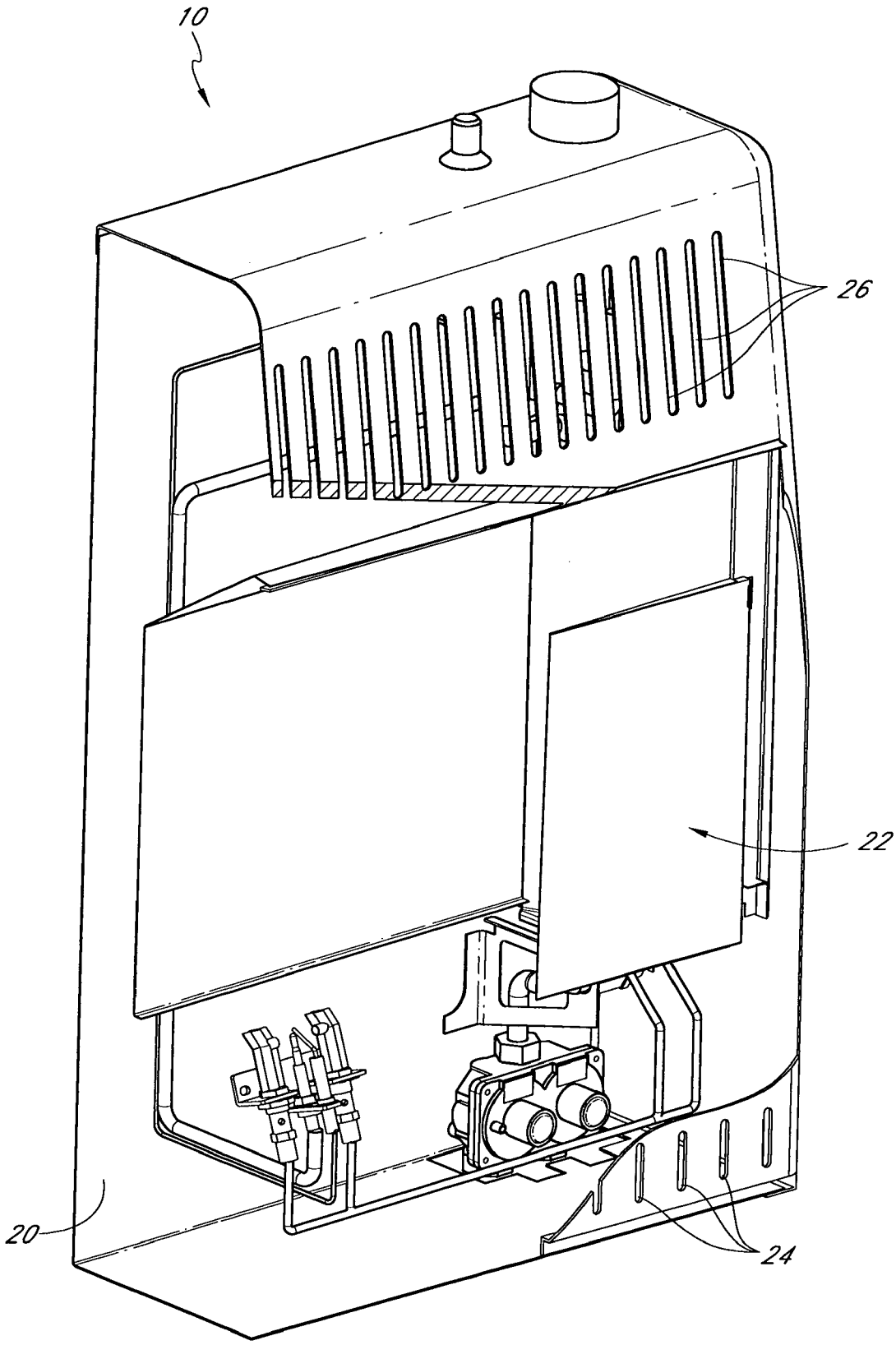
FIG. 1 is a perspective cutaway view of a portion of one embodiment of a heater configured to operate using either a first fuel source or a second fuel source.

FIG. 1 illustrates one embodiment of a heater 10. In various embodiments, the heater 10 is a vent-free infrared heater, a vent-free blue flame heater, or some other variety of heater, such as a direct vent heater. Some embodiments include stoves, fireplaces, and gas logs. Other configurations are also possible for the heater 10. In many embodiments, the heater 10 is configured to be mounted to a wall or a floor or to otherwise rest in a substantially static position. In other embodiments, the heater 10 is configured to move within a limited range. In still other embodiments, the heater 10 is portable.

In certain embodiments, the heater 10 comprises a housing 20. The housing 20 can include metal or some other suitable material for providing structure to the heater 10 without melting or otherwise deforming in a heated environment. In some embodiments, the housing 20 comprises a window 22 through which heated air and/or radiant energy can pass. In further embodiments, the housing 20 comprises one or more intake vents 24 through which air can flow into the heater 10. In some embodiments, the frame comprises outlet vents 26 through which heated air can flow out of the heater 10.

Figure 2:
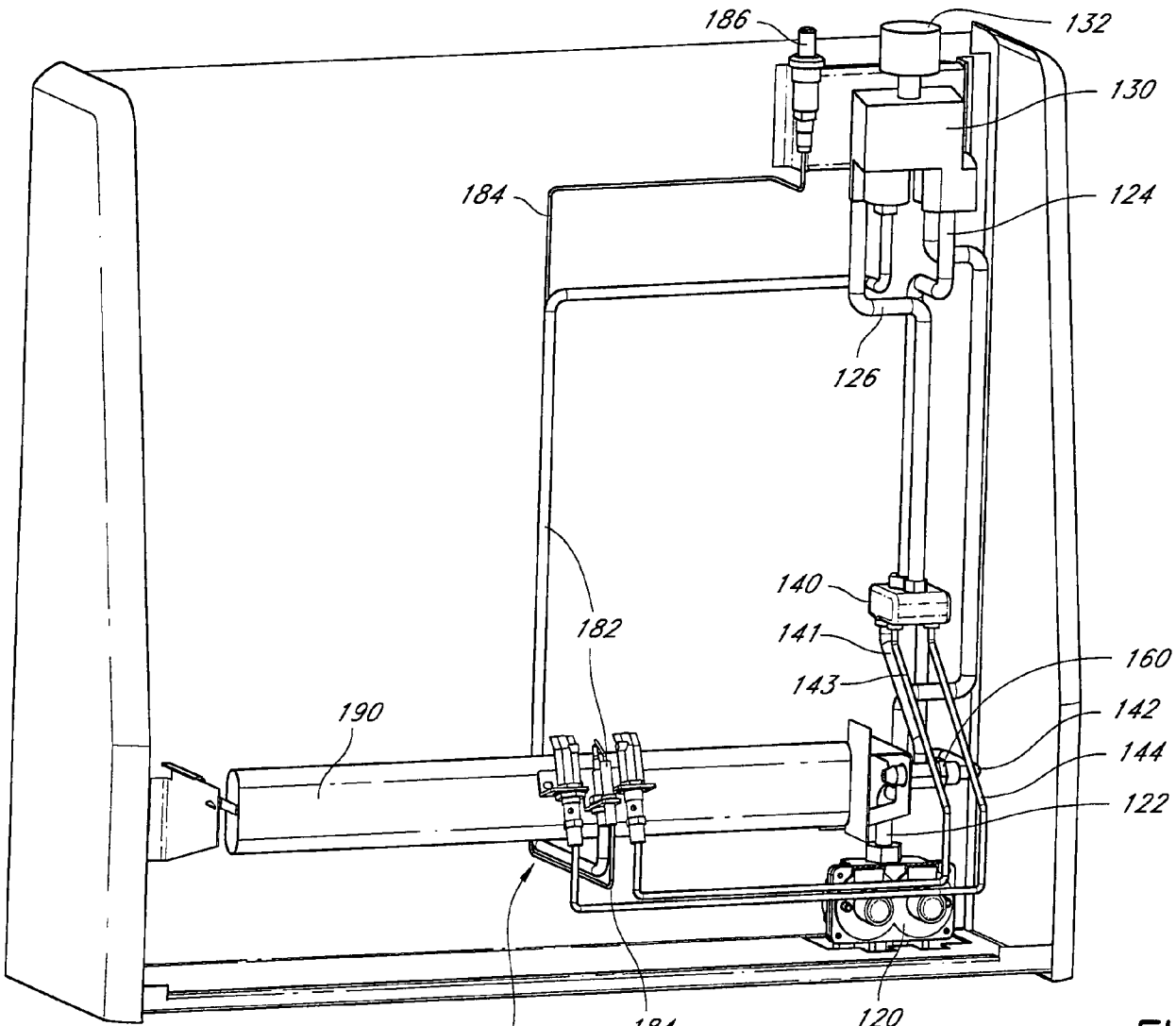
FIG. 2 is a perspective cutaway view of the heater of FIG. 1.
Figure 3:
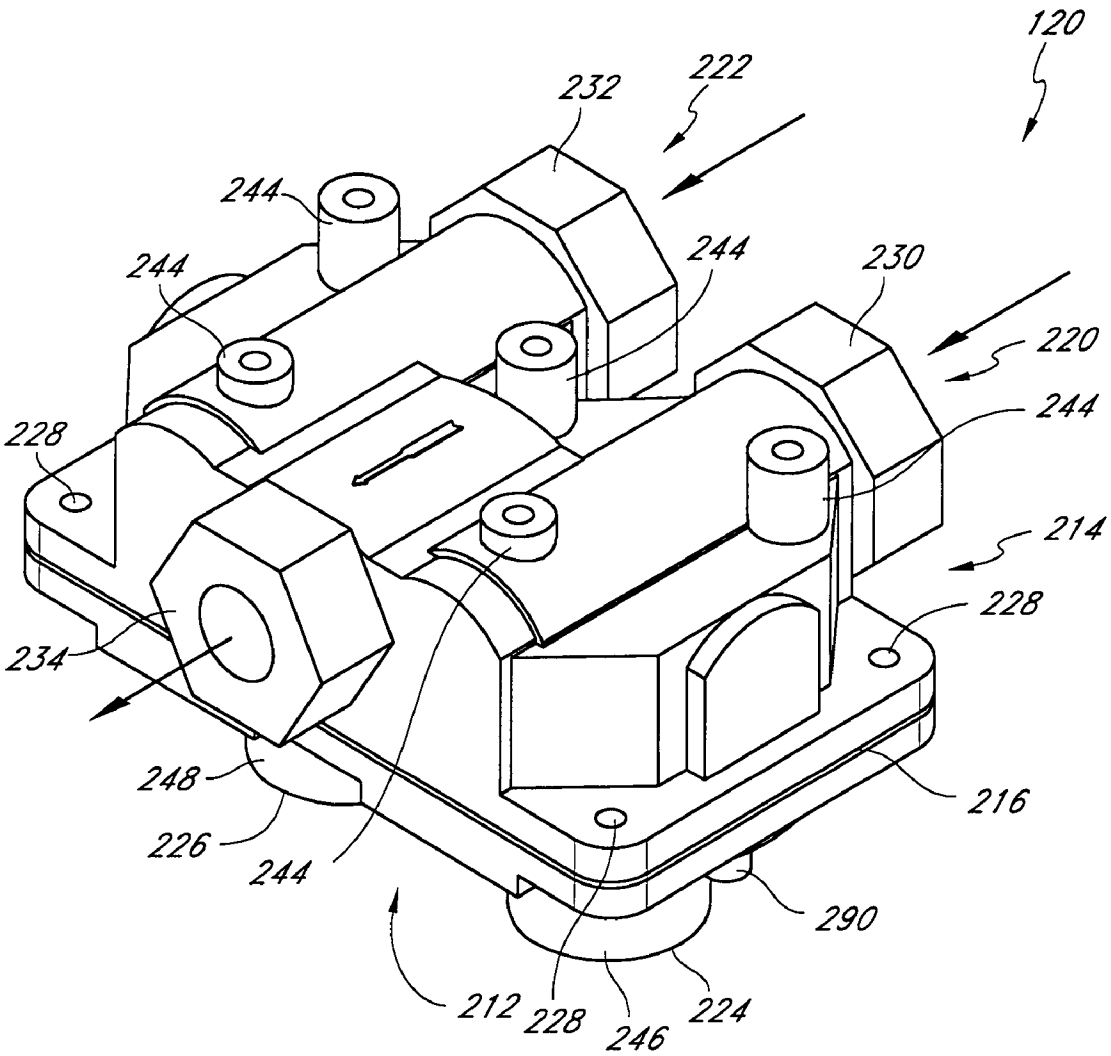
FIG. 3 is a bottom perspective view of one embodiment of a pressure regulator configured to couple with either the first fuel source or the second fuel source.
Figure 4:
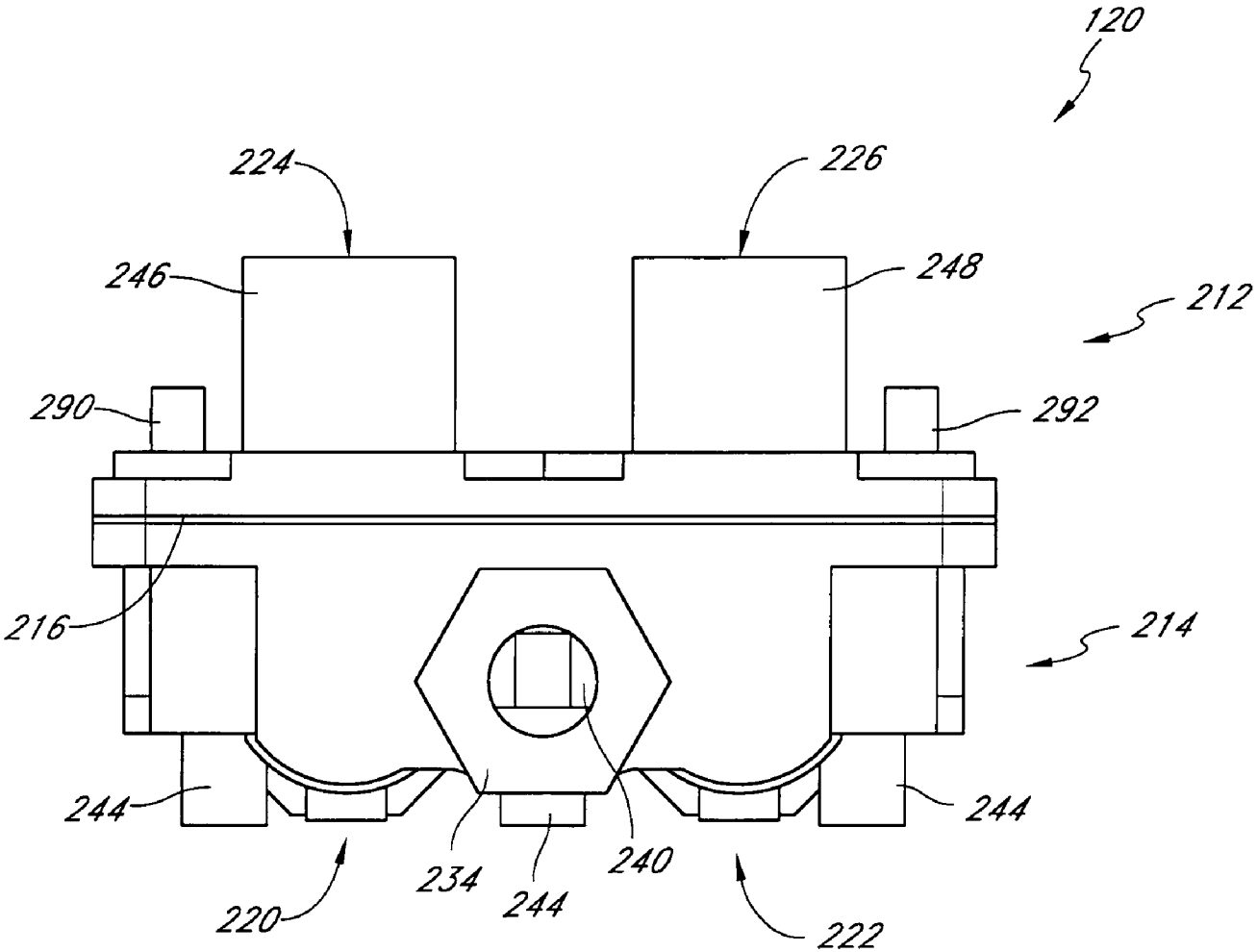
FIG. 4 is a back elevation view of the pressure regulator of FIG. 3.
Figure 5:
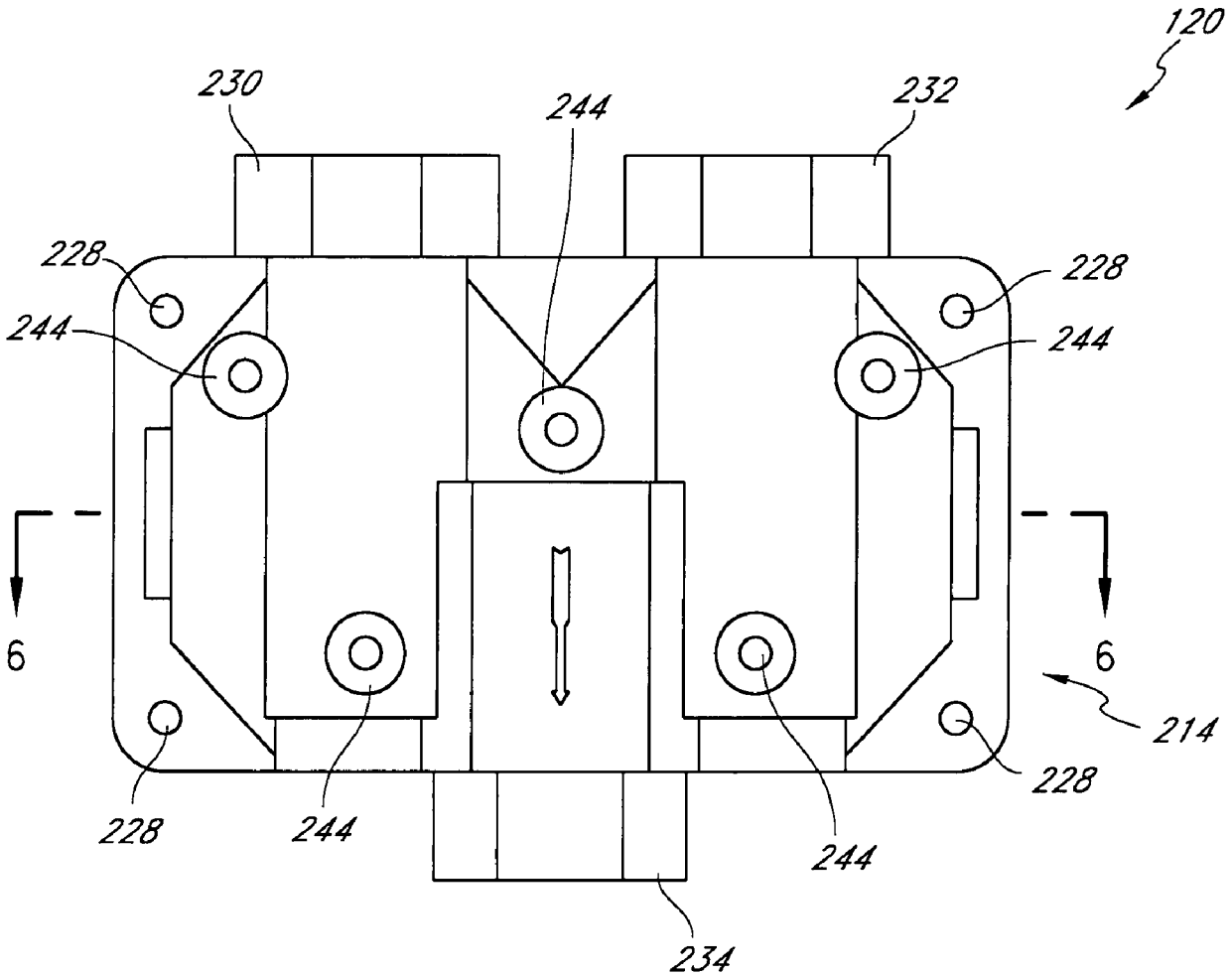
FIG. 5 is a bottom plan view of the pressure regulator of FIG. 3.
Figure 6:
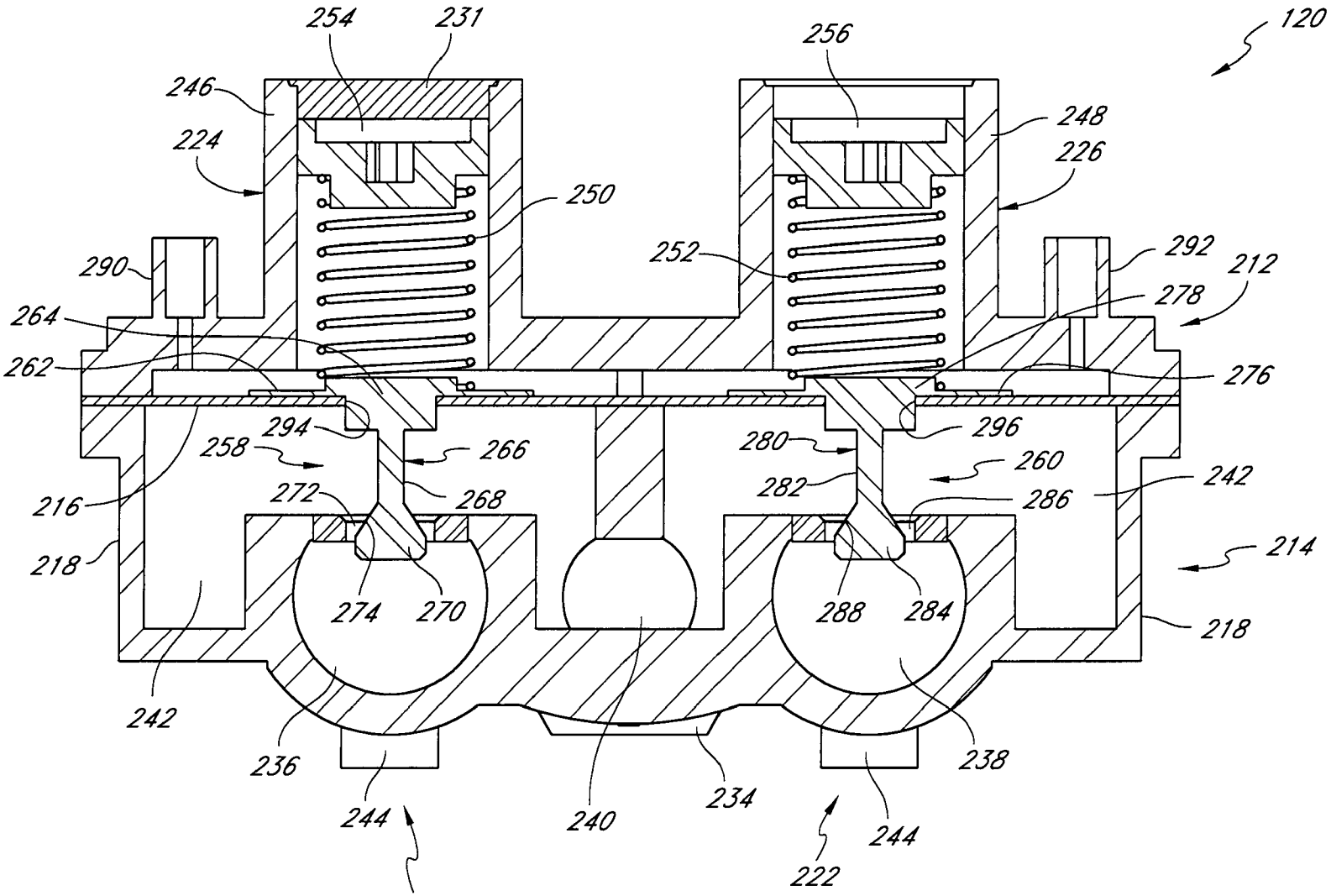
FIG. 6 is a cross-sectional view of the pressure regulator of FIG. 3 taken along the line 6-6 in FIG. 5.
Figure 7:
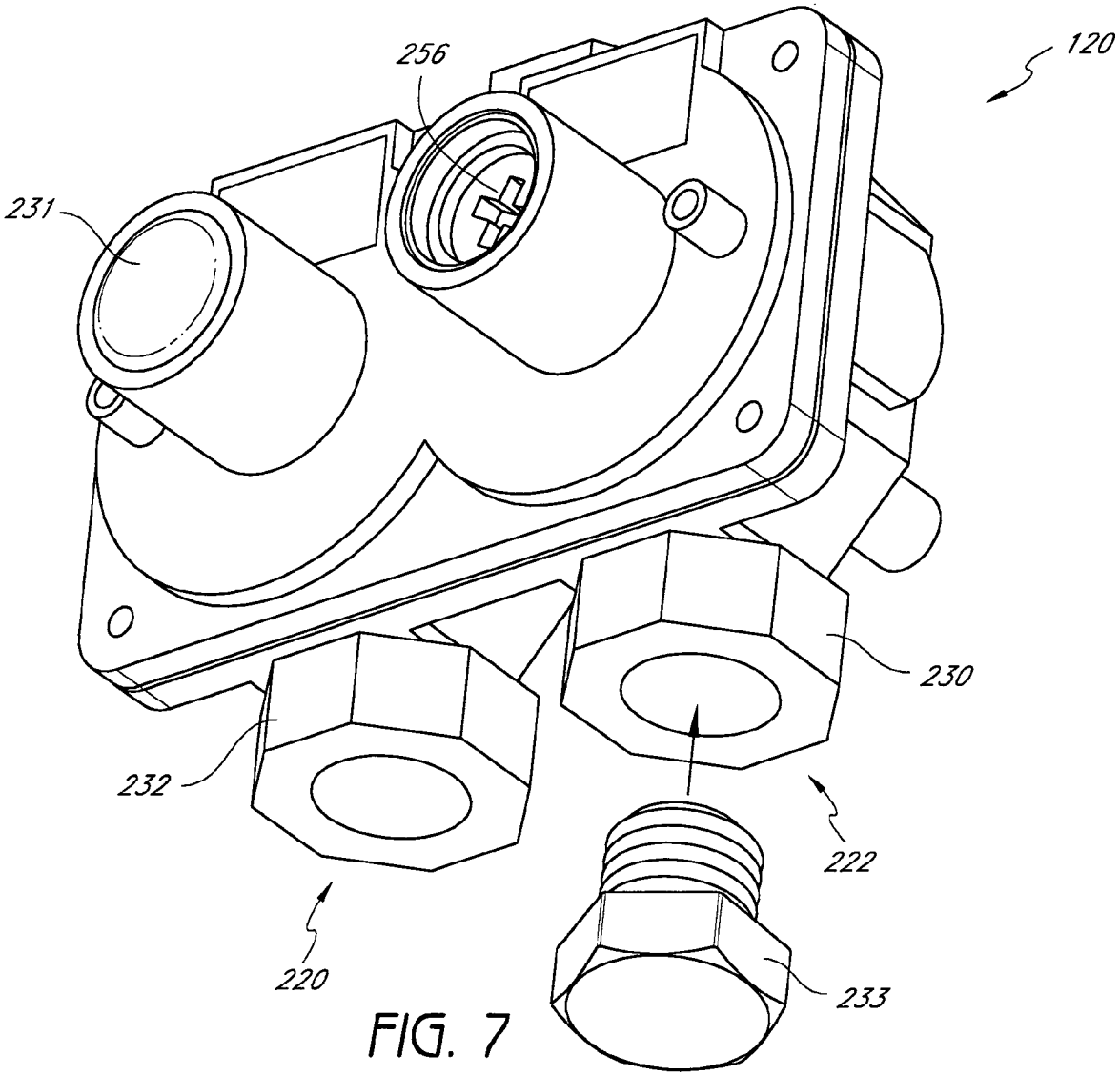
FIG. 7 is a top perspective view of the pressure regulator of FIG. 3.

With reference to FIG. 2, in certain embodiments, the heater 10 includes a regulator 120. In some embodiments, the regulator 120 is coupled with an output line or intake line, conduit, or pipe 122. The intake pipe 122 can be coupled with a heater control valve 130, which, in some embodiments, includes a knob 132. In many embodiments, the heater control valve 130 is coupled to a fuel supply pipe 124 and an oxygen depletion sensor (ODS) pipe 126, each of which can be coupled with a fluid flow controller 140. In some embodiments, the fluid flow controller 140 is coupled with a first nozzle line 141, a second nozzle line 142, a first ODS line 143, and a second ODS line 144. In some embodiments, the first and the second nozzle lines 141, 142 are coupled with a nozzle 160, and the first and the second ODS lines 143, 144 are coupled with an ODS 180. In some embodiments, the ODS comprises a thermocouple 182, which can be coupled with the heater control valve 130, and an igniter line 184, which can be coupled with an igniter switch 186. Each of the pipes 122, 124, and 126 and the lines 141-144 can define a fluid passageway or flow channel through which a fluid can move or flow.

In some embodiments, the heater 10 comprises a combustion chamber 190. In some embodiments, the ODS 180 is mounted to the combustion chamber 190, as shown in the illustrated embodiment. In further embodiments, the nozzle 160 is positioned to discharge a fluid, which may be a gas, liquid, or combination thereof into the combustion chamber 190. For purposes of brevity, recitation of the term "gas or liquid" hereafter shall also include the possibility of a combination of a gas and a liquid. In addition, as used herein, the term "fluid" is a broad term used in its ordinary sense, and includes materials or substances capable of fluid flow, such as gases, liquids, and combinations thereof.

In certain preferred embodiments, either a first or a second fluid is introduced into the heater 10 through the regulator 120. In certain embodiments, the first or the second fluid proceeds from the regulator 120 through the intake pipe 122 to the heater control valve 130. In some embodiments, the heater control valve 130 can permit a portion of the first or the second fluid to flow into the fuel supply pipe 124 and permit another portion of the first or the second fluid to flow into the ODS pipe 126, as described in further detail below.

In certain embodiments, the first or the second fluid can proceed to the fluid flow controller 140. In many embodiments, the fluid flow controller 140 is configured to channel the respective portions of the first fluid from the fuel supply pipe 124 to the first nozzle line 141 and from the ODS pipe 126 to the first ODS line 143 when the fluid flow controller 140 is in a first state, and is configured to channel the respective portions of the second fluid from the fuel supply pipe 124 to the second nozzle line 142 and from the ODS pipe 126 to the second ODS line 144 when the fluid flow controller 140 is in a second state.

In certain embodiments, when the fluid flow controller 140 is in the first state, a portion of the first fluid proceeds through the first nozzle line 141, through the nozzle 160 and is delivered to the combustion chamber 190, and a portion of the first fluid proceeds through the first ODS line 143 to the ODS 180. Similarly, when the fluid flow controller 140 is in the second state, a portion of the second fluid proceeds through the nozzle 160 and another portion proceeds to the ODS 180. As discussed in more detail below, other configurations are also possible.

With reference to FIGS. 3-7, certain embodiments of the pressure regulator 120 will now be described. FIGS. 3-7 depict different views of one embodiment of the pressure regulator 120. The regulator 120 desirably provides an adaptable and versatile system and mechanism which allows at least two fuel sources to be selectively and independently utilized with the heater 10. In some embodiments, the fuel sources comprise natural gas and propane, which in some instances can be provided by a utility company or distributed in portable tanks or vessels.

In certain embodiments, the heater 10 and/or the regulator 120 are preset at the manufacturing site, factory, or retailer to operate with selected fuel sources. As discussed below, in many embodiments, the regulator 120 includes one or more caps 231 to prevent consumers from altering the pressure settings selected by the manufacturer. Optionally, the heater 10 and/or the regulator 120 can be configured to allow an installation technician and/or user or customer to adjust the heater 10 and/or the regulator 120 to selectively regulate the heater unit for a particular fuel source.

In many embodiments, the regulator 120 comprises a first, upper, or top portion or section 212 sealingly engaged with a second, lower, or bottom portion or section 214. In some embodiments, a flexible diaphragm 216 or the like is positioned generally between the two portions 212, 214 to provide a substantially airtight engagement and generally define a housing or body portion 218 of the second portion 212 with the housing 218 also being sealed from the first portion 212. In some embodiments, the regulator 120 comprises more than one diaphragm 216 for the same purpose.

In certain embodiments, the first and second portions 212, 214 and diaphragm 216 comprise a plurality of holes or passages 228. In some embodiments, a number of the passages 228 are aligned to receive a pin, bolt, screw, or other fastener to securely and sealingly fasten together the first and second portions 212, 214. Other fasteners such as, but not limited to, clamps, locks, rivet assemblies, or adhesives may be efficaciously used.

In some embodiments, the regulator 120 comprises two selectively and independently operable pressure regulators or actuators 220 and 222 which are independently operated depending on the fuel source, such as, but not limited to, natural gas and propane. In some embodiments, the first pressure regulator 220 comprises a first spring-loaded valve or valve assembly 224 and the second pressure regulator 222 comprises a second spring-loaded valve or valve assembly 226.

In certain embodiments, the second portion 214 comprises a first fluid opening, connector, coupler, port, or inlet 230 configured to be coupled to a first fuel source. In further embodiments, the second portion 214 comprises a second fluid opening, connector, coupler, port, or inlet 232 configured to be coupled to a second fuel source. In some embodiments, the second connector 232 is threaded. In some embodiments, the first connector 230 and/or the first fuel source comprises liquid propane and the second fuel source comprises natural gas, or vice versa. The fuel sources can efficaciously comprise a gas, a liquid, or a combination thereof.

In certain embodiments, the second portion 214 further comprises a third fluid opening, connector, port, or outlet 234 configured to be coupled with the intake pipe 122 of the heater 10. In some embodiments, the connector 234 comprises threads for engaging the intake pipe 122. Other connection interfaces may also be used.

In some embodiments, the housing 218 of the second portion 214 defines at least a portion of a first input channel or passage 236, a second input channel or passage 238, and an output channel or passage 240. In many embodiments, the first input channel 236 is in fluid communication with the first connector 230, the second input channel 238 is in fluid communication with the second connector 232, and the output channel 240 is in fluid communication with the third connector 234.

In certain embodiments, the output channel 240 is in fluid communication with a chamber 242 of the housing 218 and the intake pipe 122 of the heater 10. In some embodiments, the input channels 236, 238 are selectively and independently in fluid communication with the chamber 242 and a fuel source depending on the particular fuel being utilized for heating.

In one embodiment, when the fuel comprises natural gas, the second input connector 232 is sealingly plugged by a plug or cap 233 (see FIG. 7) while the first input connector 230 is connected to and in fluid communication with a fuel source that provides natural gas for combustion and heating. In certain embodiments, the cap 233 comprises threads or some other suitable fastening interface for engaging the connector 232. The natural gas flows in through the first input channel 236 into the chamber 242 and out of the chamber 242 through the output channel 240 and into the intake pipe 122 of the heater 10.

In another embodiment, when the fuel comprises propane, the first input connector 230 is sealingly plugged by a the plug or cap 233 while the second input connector 232 is connected to and in fluid communication with a fuel source that provides propane for combustion and heating. The propane flows in through the second input channel 238 into the chamber 242 and out of the chamber 242 through the output channel 240 and into the intake pipe 122 of the heater 10. As one having skill in the art would appreciate, when the cap 233 is coupled with either the first input connector 230 or the second input connector 232 prior to packaging or shipment of the heater 10, it can have the added advantage of helping consumers distinguish the first input connector 230 from the second input connector 232.

In some embodiments, the regulator 120 comprises a single input connector that leads to the first input channel 236 and the second input channel 238. In certain of such embodiments, either a first pressurized source of liquid or gas or a second pressurized source of liquid or gas can be coupled with the same input connector. In certain of such embodiments, a valve or other device is employed to seal one of the first input channel 236 or the second input channel 238 while leaving the remaining desired input channel 236, 238 open for fluid flow.

In certain embodiments, the second portion 214 comprises a plurality of connection or mounting members or elements 244 that facilitate mounting of the regulator 120 to a suitable surface of the heater 10. The connection members 244 can comprise threads or other suitable interfaces for engaging pins, bolts, screws, or other fasteners to securely mount the regulator 120. Other connectors or connecting devices such as, but not limited to, clamps, locks, rivet assemblies, and adhesives may be efficaciously used, as needed or desired.

In certain embodiments, the first portion 212 comprises a first bonnet 246, a second bonnet 248, a first spring or resilient biasing member 250 positioned in the bonnet 246, a second spring or resilient biasing member 252 positioned in the bonnet 248, a first pressure adjusting or tensioning screw 254 for tensioning the spring 250, a second pressure adjusting or tensioning screw 256 for tensioning the spring 252 and first and second plunger assemblies 258 and 260 which extend into the housing 218 of the second portion 214. In some embodiments, the springs 250, 252 comprise steel wire. In some embodiments, at least one of the pressure adjusting or tensioning screws 254, 256 may be tensioned to regulate the pressure of the incoming fuel depending on whether the first or second fuel source is utilized. In some embodiments, the appropriate pressure adjusting or tensioning screws 254, 256 are desirably tensioned by a predetermined amount at the factory or manufacturing facility to provide a preset pressure or pressure range. In other embodiments, this may be accomplished by a technician who installs the heater 10. In many embodiments, caps 231 are placed over the screws 254, 256 to prevent consumers from altering the preset pressure settings.

In certain embodiments, the first plunger assembly 258 generally comprises a first diaphragm plate or seat 262 which seats the first spring 250, a first washer 264 and a movable first plunger or valve stem 266 that extends into the housing 218 of the second portion 214. The first plunger assembly 258 is configured to substantially sealingly engage the diaphragm 216 and extend through a first orifice 294 of the diaphragm 216.

In some embodiments, the first plunger 266 comprises a first shank 268 which terminates at a distal end as a first seat 270. The seat 270 is generally tapered or conical in shape and selectively engages a first O-ring or seal ring 272 to selectively substantially seal or allow the first fuel to flow through a first orifice 274 of the chamber 242 and/or the first input channel 236.

In certain embodiments, the tensioning of the first screw 254 allows for flow control of the first fuel at a predetermined first pressure or pressure range and selectively maintains the orifice 274 open so that the first fuel can flow into the chamber 242, into the output channel 240 and out of the outlet 234 and into the intake pipe 122 of the heater 10 for downstream combustion. If the first pressure exceeds a first threshold pressure, the first plunger seat 270 is pushed towards the first seal ring 272 and seals off the orifice 274, thereby terminating fluid communication between the first input channel 236 (and the first fuel source) and the chamber 242 of the housing 218.

In some embodiments, the first pressure or pressure range and the first threshold pressure are adjustable by the tensioning of the first screw 254. In certain embodiments, the pressure selected depends at least in part on the particular fuel used, and may desirably provide for safe and efficient fuel combustion and reduce, mitigate, or minimize undesirable emissions and pollution. In some embodiments, the first screw 254 may be tensioned to provide a first pressure in the range from about 3 inches of water column to about 6 inches of water column, including all values and sub-ranges therebetween. In some embodiments, the first threshold or flow-terminating pressure is about 3 inches of water column, about 4 inches of water column, about 5 inches of water column, or about 6 inches of water column. In certain embodiments, when the first inlet 230 and the first input channel 236 are being utilized to provide a given fuel, the second inlet 232 is plugged or substantially sealed.

In certain embodiments, the first pressure regulator 220 (and/or the first valve assembly 224) comprises a vent 290 or the like at the first portion 212. The vent can be substantially sealed, capped, or covered by a dustproof cap or cover, often for purposes of shipping. The cover is often removed prior to use of the regulator 120. In many embodiments, the vent 290 is in fluid communication with the bonnet 246 housing the spring 250 and may be used to vent undesirable pressure build-up and/or for cleaning or maintenance purposes.

In certain embodiments, the second plunger assembly 260 generally comprises a second diaphragm plate or seat 276 which seats the second spring 252, a second washer 278 and a movable second plunger or valve stem 280 that extends into the housing 218 of the second portion 214. The second plunger assembly 260 substantially sealingly engages the diaphragm 216 and extends through a second orifice 296 of the diaphragm 216.

In certain embodiments, the second plunger 280 comprises a second shank 282 which terminates at a distal end as a second seat 284. The seat 284 is generally tapered or conical in shape and selectively engages a second O-ring or seal ring 286 to selectively substantially seal or allow the second fuel to flow through a second orifice 288 of the chamber 242 and/or the second input channel 238.

In certain embodiments, the tensioning of the second screw 256 allows for flow control of the second fuel at a predetermined second pressure or pressure range and selectively maintains the orifice 288 open so that the second fuel can flow into the chamber 242, into the output channel 240 and out of the outlet 234 and into the intake pipe 122 of the heater 10 for downstream combustion. If the second pressure exceeds a second threshold pressure, the second plunger seat 284 is pushed towards the second seal ring 286 and seals off the orifice 288, thereby terminating fluid communication between the second input channel 238 (and the second fuel source) and the chamber 242 of the housing 218.

In certain embodiments, the second pressure or pressure range and the second threshold pressure are adjustable by the tensioning of the second screw 256. In some embodiments, the second screw 256 may be tensioned to provide a second pressure in the range from about 8 inches of water column to about 12 inches of water column, including all values and sub-ranges therebetween. In some embodiments, the second threshold or flow-terminating pressure is about equal to 8 inches of water column, about 9 inches of water column, about 10 inches of water column, about 11 inches of water column, or about 12 inches of water column. In certain embodiments, when the second inlet 232 and the second input channel 238 are being utilized to provide a given fuel, the first inlet 230 is plugged or substantially sealed.

In certain embodiments, the second pressure regulator 222 (and/or the second valve assembly 226) comprises a vent 292 or the like at the first portion 212. The vent can be substantially sealed, capped or covered by a dustproof cap or cover. The vent 292 is in fluid communication with the bonnet 248 housing the spring 252 and may be used to vent undesirable pressure build-up and/or for cleaning or maintenance purposes and the like.

In some embodiments, when natural gas is the first fuel and propane is the second fuel, the first pressure, pressure range and threshold pressure are less than the second pressure, pressure range and threshold pressure. Stated differently, in some embodiments, when natural gas is the first fuel and propane is the second fuel, the second pressure, pressure range and threshold pressure are greater than the first pressure, pressure range and threshold pressure.

Advantageously, the dual regulator 120, by comprising first and second pressure regulators 220, 222 and corresponding first and second valves or valve assemblies 224, 226, which are selectively and independently operable facilitates a single heater unit being efficaciously used with different fuel sources. This desirably saves on inventory costs, offers a retailer or store to stock and provide a single unit that is usable with more than one fuel source, and permits customers the convenience of readily obtaining a unit which operates with the fuel source of their choice. The particular fuel pressure operating range is desirably factory-preset to provide an adaptable and versatile heater.

The pressure regulating device 120 can comprise a wide variety of suitably durable materials. These include, but are not limited to, metals, alloys, ceramics, plastics, among others. In one embodiment, the pressure regulating device 120 comprises a metal or alloy such as aluminum or stainless steel. The diaphragm 216 can comprise a suitable durable flexible material, such as, but not limited to, various rubbers, including synthetic rubbers. Various suitable surface treatments and finishes may be applied with efficacy, as needed or desired.

In certain embodiments, the pressure regulating device 120 can be fabricated or created using a wide variety of manufacturing methods, techniques and procedures. These include, but are not limited to, casting, molding, machining, laser processing, milling, stamping, laminating, bonding, welding, and adhesively fixing, among others.

Although the regulator 120 has been described as being integrated in the heater 10, the regulator 120 is not limited to use with heating devices, and can benefit various other applications. Additionally, pressure ranges and/or fuel-types that are disclosed with respect to one portion of the regulator 120 can also apply to another portion of the regulator 120. For example, tensioning of either the first screw 254 or the second screw 256 can result in pressure ranges between about 3 inches of water column and about 6 inches of water column or between about 8 inches of water column and about 12 inches of water column, in some embodiments.

As noted above, in certain embodiments, the regulator 120 is configured to allow passage therethrough of either a first or a second fuel. In certain embodiments, the first or the second fuel passes through the intake pipe 122 to the heater control valve 130.

Figure 8:
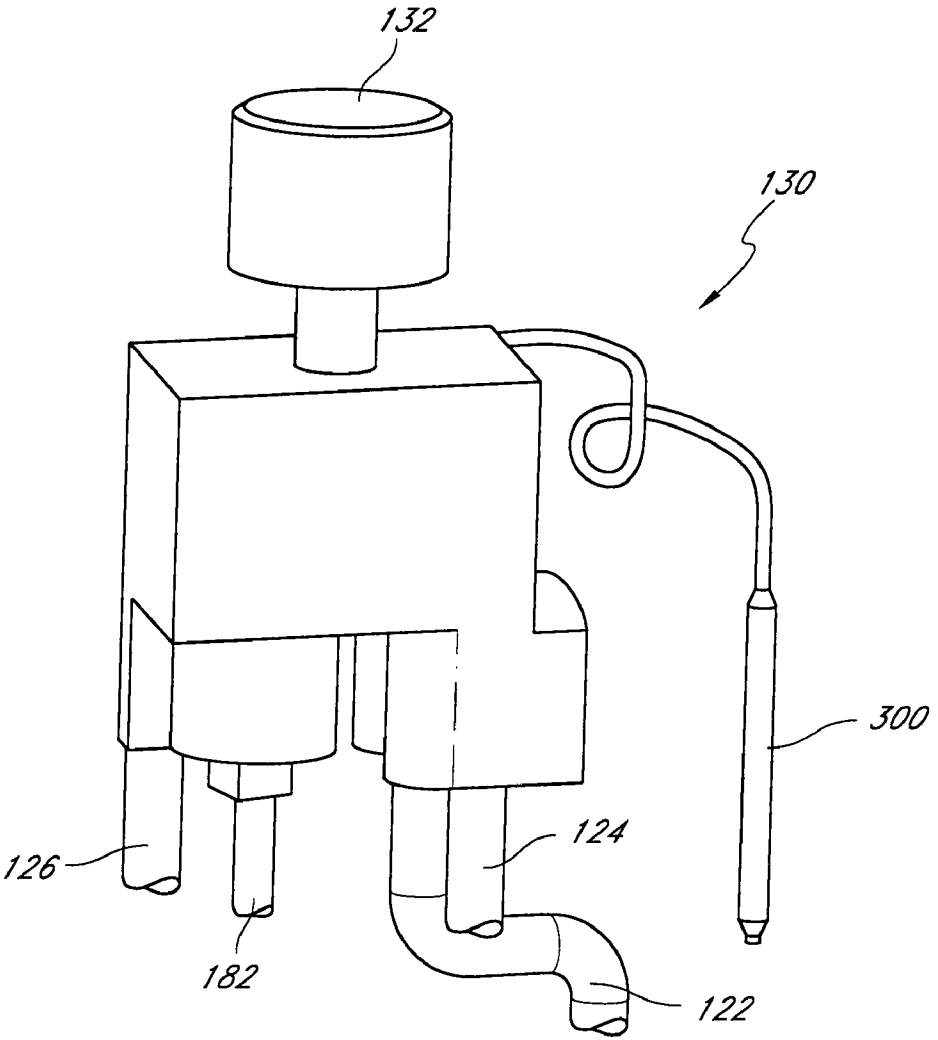
FIG. 8 is a perspective view of one embodiment of a heat control valve.

With reference to FIG. 8, in certain embodiments, the heater control valve 130 includes the knob 132. The heater control valve 130 can be coupled with the intake pipe 122, the fuel supply pipe 124 and the ODS pipe 126. In certain embodiments, the heater control valve 130 is coupled with the ODS thermocouple 182. In further embodiments, the heater control valve 130 comprises a temperature sensor 300.

In some embodiments, the heater control valve 130 allows a portion of the first or the second fuel to pass from the intake pipe 122 to the fuel supply pipe 124 and another portion to pass to the ODS pipe 126. In certain embodiments, the amount of fuel passing through the heater control valve 130 is influenced by the settings of the knob 132 and/or the functioning of the thermocouple 182. In some embodiments, the knob 132 is rotated by a user to select a desired temperature. Based on the temperature selected by the user and the temperature sensed by the temperature sensor 300, the heater control valve 130 can allow more or less fuel to pass to the fuel supply pipe 124.

Furthermore, as discussed below, when a pilot light of the ODS heats the thermal couple 182, a current is generated in the thermocouple 182. In certain embodiments, this current produces a magnetic field within the heater control valve 130 that maintains the valve 130 in an open position. If the pilot light goes out or is disturbed, and the current flow is reduced or terminated, the magnetic field weakens or is eliminated, and the valve 130 closes, thereby preventing passage therethrough of the first or the second fuel.

Figure 9:
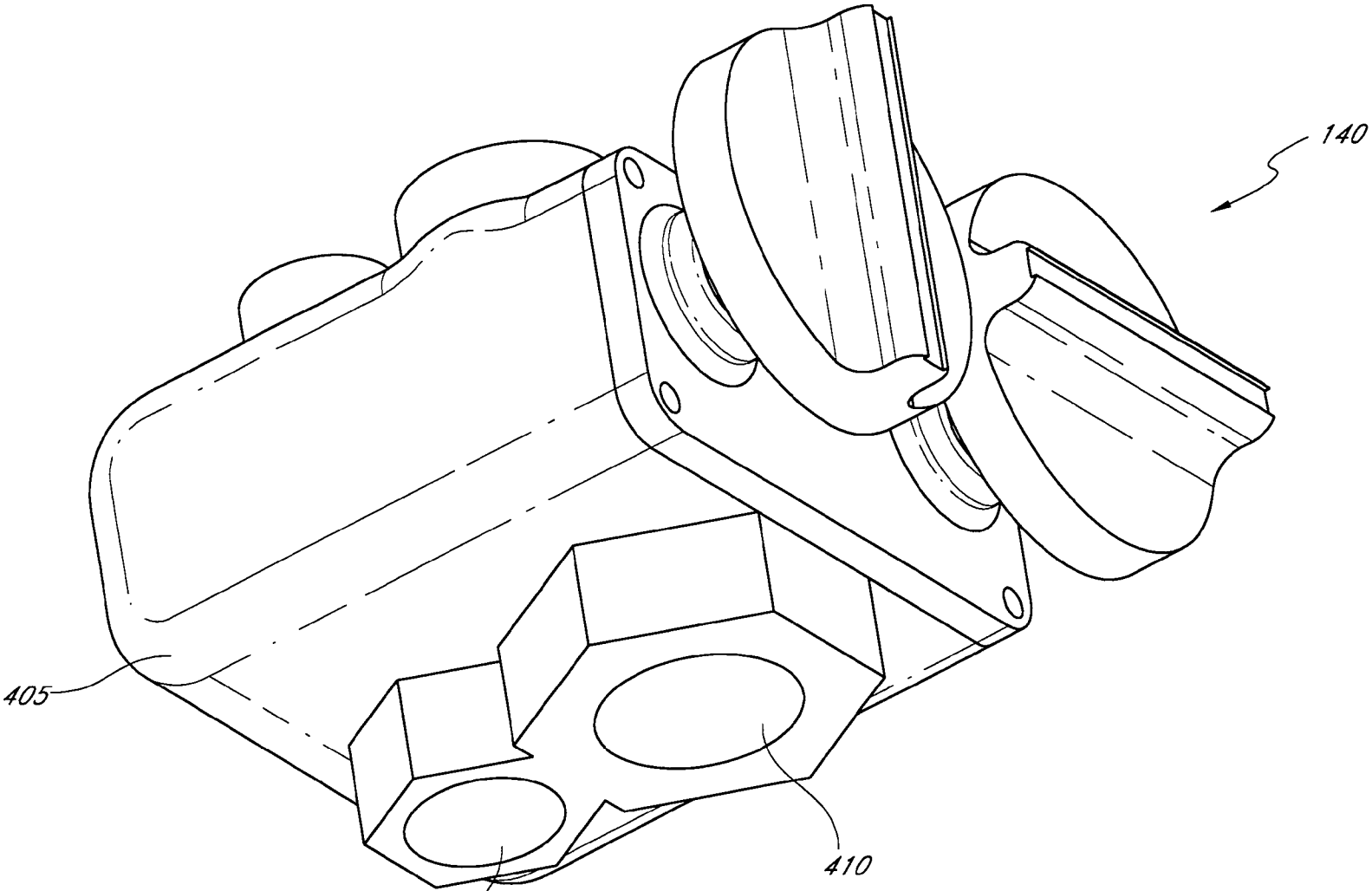
FIG. 9 is a perspective view of one embodiment of a fluid flow controller comprising two valves.

With reference to FIG. 9, in certain embodiments, the first or the second fuel allowed through the heater control valve 130 proceeds to the fluid flow controller 140. In certain embodiments, the controller 140 comprises a housing 405, a first inlet 410, and a second inlet 420. In some embodiments, the first inlet 410 is configured to couple with the fuel supply pipe 124 and the second inlet 420 is configured to couple with the ODS pipe 126.

Figure 10:
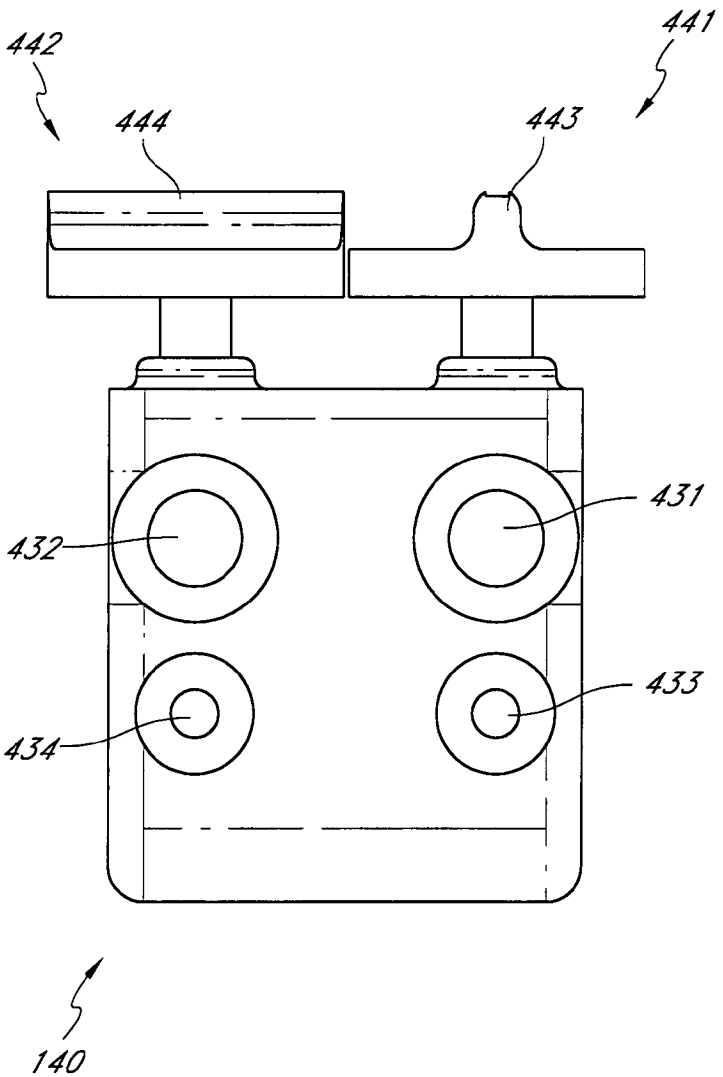
FIG. 10 is a bottom plan view of the fluid flow controller of FIG. 9.

With reference to FIG. 10, in certain embodiments, the fluid flow controller 140 comprises a first fuel supply outlet 431, and a second fuel supply outlet 432, a first ODS outlet 433, a second ODS outlet 434. In some embodiments, the fluid flow controller 140 further comprises a first selector valve 441 and a second selector valve 442. In some embodiments, a first selector control or knob 443 is coupled to the first selector valve 441 and a second selector knob 444 is coupled to the second selector valve 442.

Figure 11:
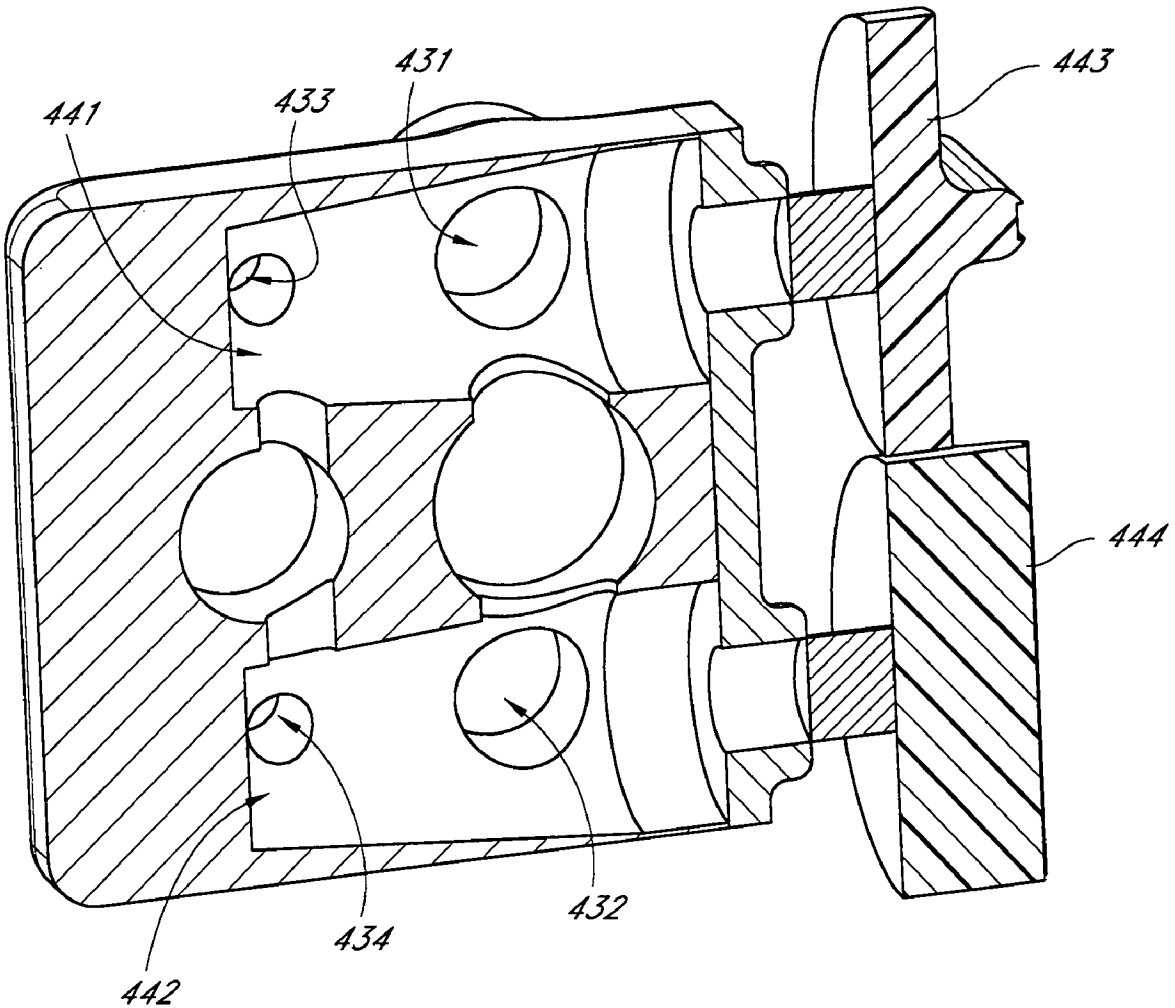
FIG. 11 is a cross-sectional view of the fluid flow controller of FIG. 9.

With reference to FIG. 11, in some embodiments, one of the first and second selector valves 441, 442 can be rotated within the housing via the first or second selector knob 443, 444, respectively. In some embodiments, the second selector valve 442 is closed and the first selector valve 441 is opened such that fluid flowing through the fuel supply pipe 124 proceeds to the first fuel supply outlet 431 and into the first nozzle line 141 and fluid flowing through the ODS pipe 126 proceeds to the first ODS outlet 433 and into the first ODS line 143. In other embodiments, the first selector valve 441 is closed and the second selector valve 442 is opened such that fluid flowing through the fuel supply pipe 124 proceeds to the second fuel supply outlet 432 and into the second nozzle line 142 and fluid flowing through the ODS pipe 126 proceeds to the second ODS outlet 434 and into the second ODS line 144. Accordingly, in certain embodiments, the fluid flow controller 140 can direct a first fluid to a first set of pipes 141, 143 leading to the nozzle 160 and the ODS 180, and can direct a second fluid to a second set of pipes 142, 144 leading to the nozzle 160 and the ODS 180.

Figure 12:
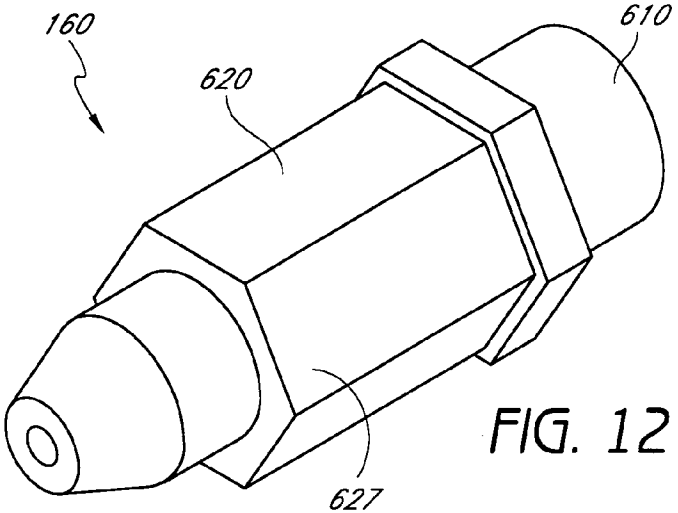
FIG. 12 is a perspective view of one embodiment of a nozzle comprising two inputs, two outputs, and two pressure chambers.

With reference to FIG. 12, in certain embodiments, the nozzle 160 comprises an inner tube 610 and an outer tube 620. The inner tube 610 and the outer tube 620 can cooperate to form a body of the nozzle 160. In some embodiments, the inner tube 610 and the outer tube 620 are separate pieces joined in substantially airtight engagement. For example, the inner tube 610 and the outer tube 620 can be welded, glued, secured in threaded engagement, or otherwise attached or secured to each other. In other embodiments, the inner tube 610 and the outer tube 620 are integrally formed of a unitary piece of material. In some embodiments, the inner tube 610 and/or the outer tube 620 comprises a metal.

Figure 13:
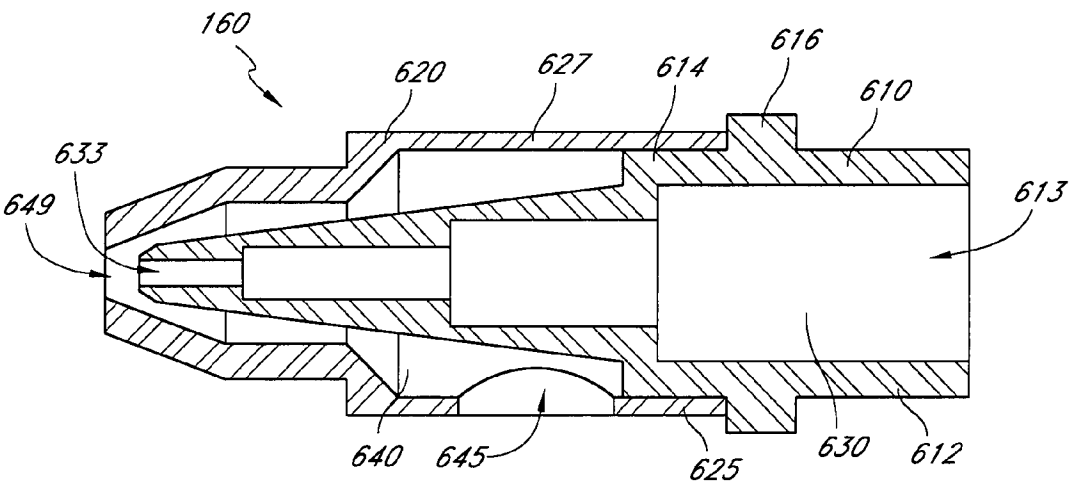
FIG. 13 is a cross-sectional view of the nozzle of FIG. 12 taken along the line 13-13 in FIG. 14.
Figure 14:
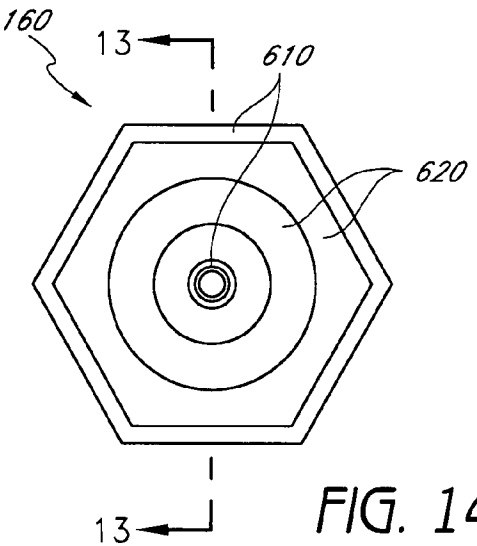
FIG. 14 is a top plan view of the nozzle of FIG. 12.

As illustrated in FIG. 13, in certain embodiments, the inner tube 610 and the outer tube 620 are elongated, substantially hollow structures. In some embodiments, a portion of the inner tube 610 extends inside the outer tube 620. As illustrated in FIGS. 13 and 14, in some embodiments, the inner tube 610 and the outer tube 620 can be substantially coaxial in some embodiments, and can be axially symmetric.

With continued reference to FIG. 13, in some embodiments, the inner tube 610 comprises a connector sheath 612. The connector sheath 612 can comprise an inlet 613 having an area through which a fluid can flow. In some embodiments, the connector sheath 612 is configured to couple with the second nozzle line 142, preferably in substantially airtight engagement. In some embodiments, an inner perimeter of the connector sheath 612 is slightly larger than an outer perimeter of the second nozzle line 142 such that the connector sheath 612 can seat snugly over the second nozzle line 142. In some embodiments, the connector sheath 612 is welded to the second nozzle line 142. In other embodiments, an interior surface of the connector sheath 612 is threaded for coupling with a threaded exterior surface of the second nozzle line 142. In still other embodiments, the second nozzle line 142 is configured to fit over the connector sheath 612.

In certain embodiments, the connector sheath 612 comprises a distal portion 614 that is configured to couple with the outer tube 620. In some preferred embodiments, each of the distal portion 614 of the inner tube 620 and a proximal portion 625 of the outer tube 620 comprises threads. Other attachment configurations are also possible.

In certain embodiments, the nozzle 160 comprises a flange 616 that extends from the connector sheath 612. In some embodiments, the flange 616 is configured to be engaged by a tightening device, such as a wrench, which can aid in securing the inner tube 610 to the outer tube 620 and/or in securing the nozzle 160 to the second nozzle line 142. In some embodiments, the flange 624 comprises two or more substantially flat surfaces, and in other embodiments, is substantially hexagonal (as shown in FIGS. 12 and 14).

In further embodiments, the outer tube 620 comprises a shaped portion 627 that is configured to be engaged by a tightening device, such as a wrench. In some embodiments, the shaped portion 627 is substantially hexagonal. In certain embodiments, the shaped portion 627 of the outer tube 620 and the flange 616 of the inner tube 610 can each be engaged by a tightening device such that the outer tube 620 and the inner tube 610 rotate in opposite directions about an axis of the nozzle 160.

In certain embodiments, the inner tube 610 defines a substantially hollow cavity or pressure chamber 630. The pressure chamber 630 can be in fluid communication with the inlet 613 and an outlet 633. In some embodiments, the outlet 633 defines an outlet area that is smaller than the area defined by the inlet 613. In preferred embodiments, the pressure chamber 630 decreases in cross-sectional area toward a distal end thereof. In some embodiments, the pressure chamber 630 comprises two or more substantially cylindrical surfaces having different radii. In some embodiments, a single straight line is collinear with or runs parallel to the axis of each of the two or more substantially cylindrical surfaces.

In some embodiments, the outer tube 620 substantially surrounds a portion of the inner tube 610. The outer tube 620 can define an outer boundary of a hollow cavity or pressure chamber 640. In some embodiments, an inner boundary of the pressure chamber 640 is defined by an outer surface of the inner tube 610. In some embodiments, an outer surface of the pressure chamber 640 comprises two or more substantially cylindrical surfaces joined by substantially sloped surfaces therebetween. In some embodiments, a single straight line is collinear with or runs parallel to the axis of each of the two or more substantially cylindrical surfaces.

In preferred embodiments, an inlet 645 and an outlet 649 are in fluid communication with the pressure chamber 640. In some embodiments, the inlet 645 extends through a sidewall of the outer tube 620. Accordingly, in some instances, the inlet 645 generally defines an area through which a fluid can flow. In some embodiments, the direction of flow of the fluid through the inlet 645 is nonparallel with the direction of flow of a fluid through the inlet 613 of the inner tube 610. In some embodiments, an axial line through the inlet 645 is at an angle with respect to an axial line through the inlet 613. The inlet 645 can be configured to be coupled with the first nozzle line 141, preferably in substantially airtight engagement. In some embodiments, an inner perimeter of the inlet 645 is slightly larger than an outer perimeter of the first nozzle line 141 such that the inlet 645 can seat snugly over the first nozzle line 141. In some embodiments, the outer tube 620 is welded to the first nozzle line 141.

In certain embodiments, the outlet 649 of the outer sheath 620 defines an area smaller than the area defined by the inlet 645. In some embodiments, the area defined by the outlet 649 is larger than the area defined by the outlet defined by the outlet 613 of the inner tube 610. In some embodiments, the outlet 613 of the inner tube 610 is within the outer tube 620. In other embodiments, the inner tube 610 extends through the outlet 649 such that the outlet 613 of the inner tube 610 is outside the outer tube 620.

In certain embodiments, a fluid exits the second nozzle line 142 and enters the pressure chamber 630 of the inner tube 610 through the inlet 613. The fluid proceeds through the outlet 633 to exit the pressure chamber 630. In some embodiments, the fluid further proceeds through a portion of the pressure chamber 640 of the outer tube 620 before exiting the nozzle 160 through the outlet 649.

In other embodiments, a fluid exits the first nozzle line 142 and enters the pressure chamber 640 of the outer tube 620 through the inlet 645. The fluid proceeds through the outlet 633 to exit the pressure chamber 640 and, in many embodiments, exit the nozzle 160. In certain embodiments, a fluid exiting the second nozzle line 142 and traveling through the pressure chamber 630 is at a higher pressure than a fluid exiting the first nozzle line 141 and traveling through the pressure chamber 640. In some embodiments, liquid propane travels through the pressure chamber 630, and in other embodiments, natural gas travels through the pressure chamber 640.

Figure 17:
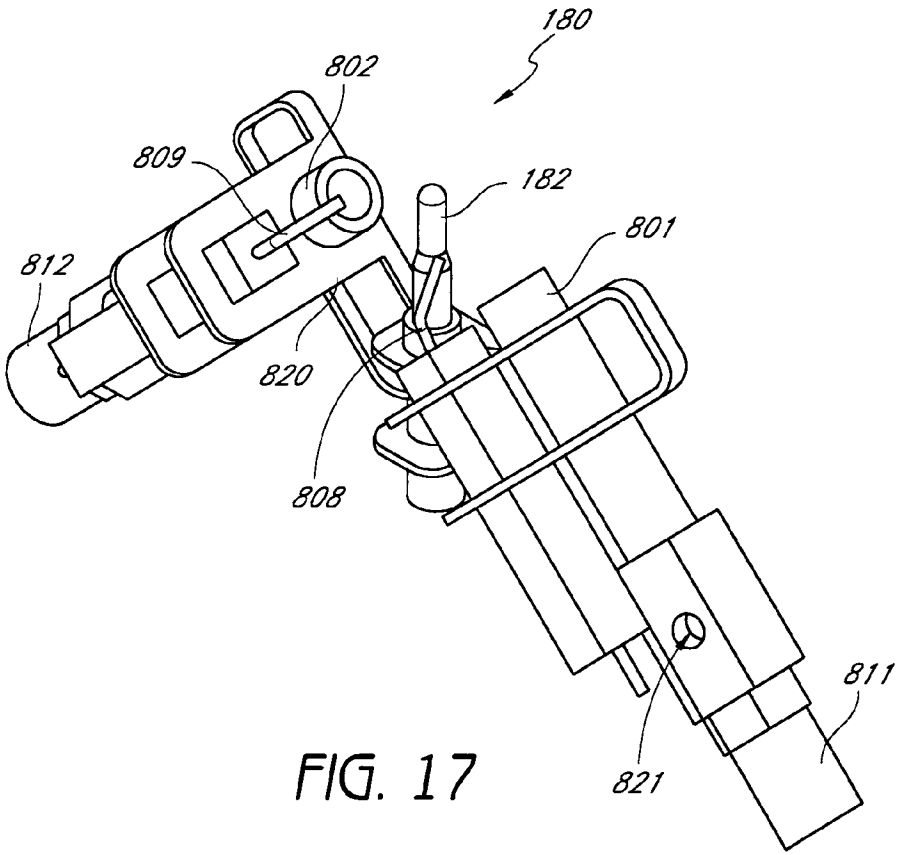
FIG. 17 is a top plan view of the ODS of FIG. 15.
Figure 15:
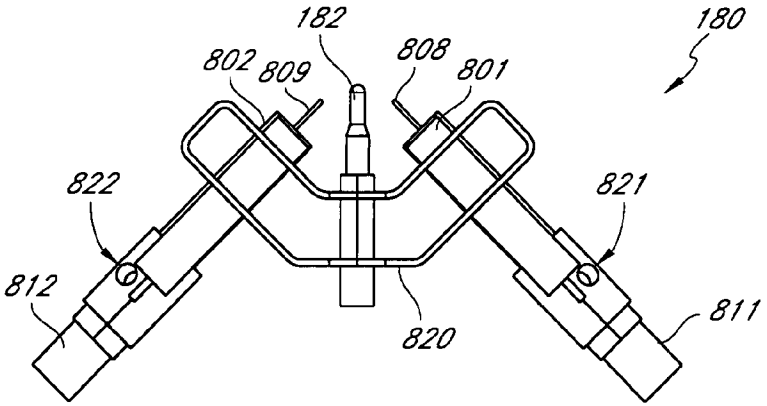
FIG. 15 is a perspective view of one embodiment of an oxygen depletion sensor (ODS) comprising two injectors and two nozzles.
Figure 16:
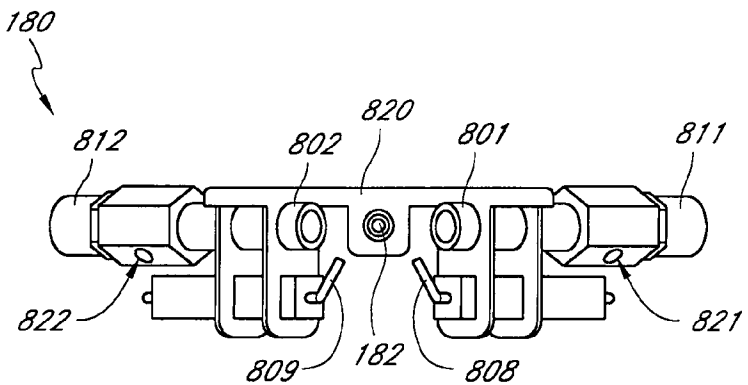
FIG. 16 is a front plan view of the ODS of FIG. 15.

With reference to FIG. 15-17, in certain embodiments, the ODS 180 comprises a thermocouple 182, a first nozzle 801, a second nozzle 802, a first electrode 808, and a second electrode 809. In further embodiments, the ODS 180 comprises a first injector 811 coupled with the first ODS line 143 (see FIGS. 1 and 2) and the first nozzle 801 and a second injector 812 coupled with the second ODS line 144 (see FIGS. 1 and 2) and the second nozzle 802. In many embodiments, the first and second injectors 811, 812 are standard injectors as are known in the art, such as injectors that can be utilized with liquid propane or natural gas. In some embodiments, the ODS 180 comprises a frame 820 for positioning the constituent parts of the ODS 180.

In some embodiments, the first nozzle 801 and the second nozzle 802 are directed toward the thermocouple such that a stable flame exiting either of the nozzles 801, 802 will heat the thermocouple 182. In certain embodiments, the first nozzle 801 and the second nozzle 802 are directed to different sides of the thermocouple 182. In some embodiments, the first nozzle 801 and the second nozzle 802 are directed to opposite sides of the thermocouple 182. In some embodiments, the first nozzle 801 is spaced at a greater distance from the thermocouple than is the second nozzle 802.

In some embodiments, the first nozzle 801 comprises a first air inlet 821 at a base thereof and the second nozzle 802 comprises a second air inlet 822 at a base thereof. In various embodiments, the first air inlet 821 is larger or smaller than the second air inlet 822. In many embodiments, the first and second injectors 811, 812 are also located at a base of the nozzles 801, 802. In certain embodiments, a gas or a liquid flows from the first ODS line 143 through the first injector 811, through the first nozzle 801, and toward the thermocouple 182. In other embodiments, a gas or a liquid flows from the second ODS line 144 through the second injector 812, through the second nozzle 802, and toward the thermocouple 182. In either case, the fluid flows near the first or second air inlets 821, 822, thus drawing in air for mixing with the fluid. In certain embodiments, the first injector 811 introduces a fluid into the first nozzle 801 at a first flow rate, and the second injector 812 introduces a fluid into the second nozzle 802 at a second flow rate. In various embodiments, the first flow rate is greater than or less than the second flow rate.

In some embodiments, the first electrode 808 is positioned at an approximately equal distance from an output end of the first nozzle 801 and an output end of the second nozzle 802. In some embodiments, a single electrode is used to ignite fuel exiting either the first nozzle 801 or the second nozzle 802. In other embodiments, a first electrode 808 is positioned closer to the first nozzle 801 than to the second nozzle 802 and the second electrode 809 is positioned nearer to the second nozzle 802 than to the first nozzle 801.

In some embodiments, a user can activate the electrode by depressing the igniter switch 186 (see FIG. 2). The electrode can comprise any suitable device for creating a spark to ignite a combustible fuel. In some embodiments, the electrode is a piezoelectric igniter.

In certain embodiments, igniting the fluid flowing through one of the first or second nozzles 801, 802 creates a pilot flame. In preferred embodiments, the first or the second nozzle 801, 802 directs the pilot flame toward the thermocouple such that the thermocouple is heated by the flame, which, as discussed above, permits fuel to flow through the heat control valve 130.

Figure 18:
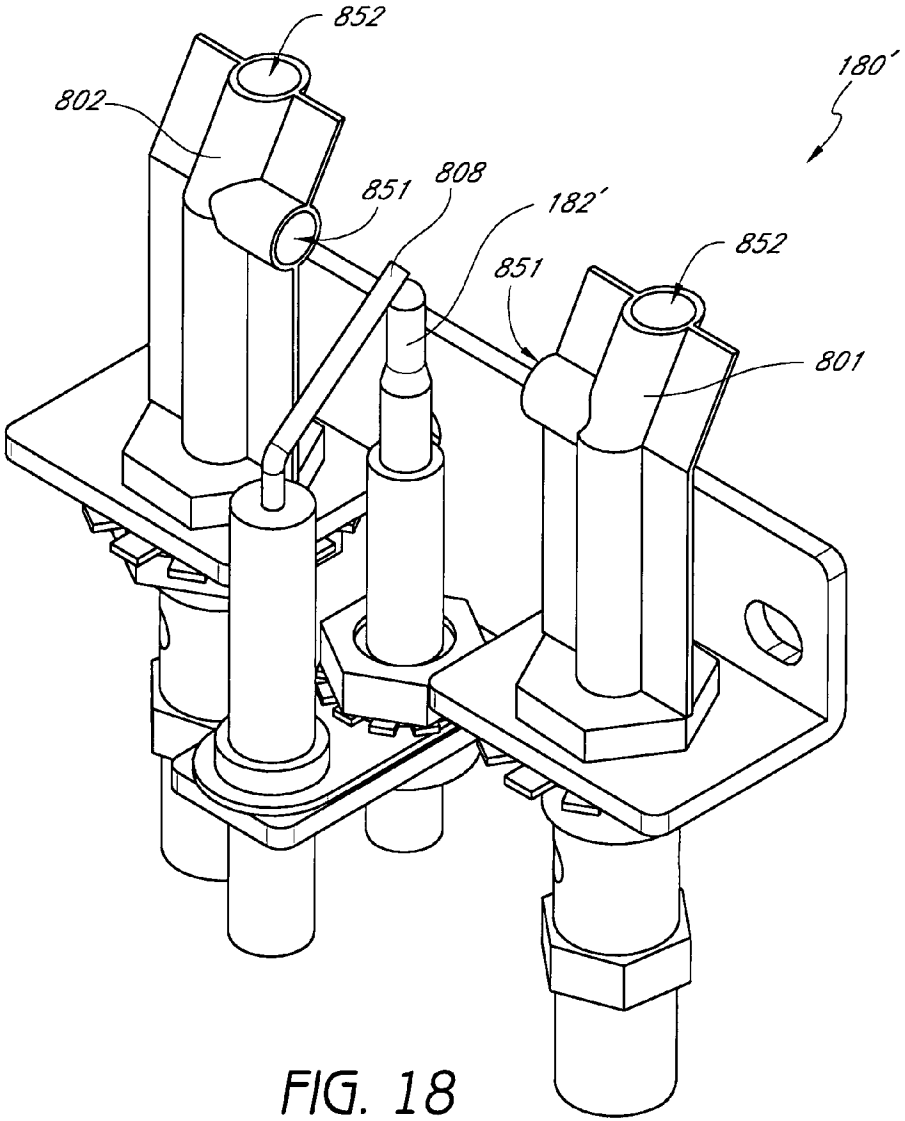
FIG. 18 is a perspective view of another embodiment of an ODS comprising two injectors and two nozzles.

FIG. 18 illustrates another embodiment of the ODS 180'. In the illustrated embodiment, the ODS 180' comprises a single electrode 808. In the illustrated embodiment, each nozzle 801, 802 comprises an first opening 851 and a second opening 852. In certain embodiments, the first opening 851 is directed toward a thermocouple 182', and the second opening 852 is directed substantially away from the thermocouple 182'.

In various embodiments, the ODS 180 provides a steady pilot flame that heats the thermocouple 182 unless the oxygen level in the ambient air drops below a threshold level. In certain embodiments, the threshold oxygen level is between about 18 percent and about 18.5 percent. In some embodiments, when the oxygen level drops below the threshold level, the pilot flame moves away from the thermocouple, the thermocouple cools, and the heat control valve 130 closes, thereby cutting off the fuel supply to the heater 10.

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures or characteristics of any embodiment described above may be combined in any suitable manner, as would be apparent to one of ordinary skill in the art from this disclosure, in one or more embodiments.

Similarly, it should be appreciated that in the above description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A heater configured to operate with either a first fuel at a first pressure or a second fuel at a second pressure, the heater comprising:

a first oxygen depletion sensor nozzle line defining a passageway;

a second oxygen depletion sensor line defining a passageway; and a first oxygen depletion sensor nozzle communicating with a fluid flow controller;

a second oxygen depletion sensor nozzle communicating with said fluid flow controller;

a first heater nozzle line defining a passageway;

a second heater nozzle line defining a passageway; and a heater nozzle comprising:

a first cavity in fluid communication with the first heater nozzle line, the first cavity having an input end configured to couple with the first heater nozzle line and an output end configured to dispense fuel at the first pressure, wherein the first cavity decreases in size toward the output end thereof; and a second cavity in fluid communication with the second heater nozzle line, the second cavity having an input end configured to couple with the second heater nozzle line and an output end configured to dispense fuel at the second pressure, wherein the second cavity decreases in size toward the output end thereof, further comprising:

said fluid flow controller configured (1) to permit the flow of fuel to the first cavity and to direct a first gas to said first oxygen depletion sensor nozzle when the controller is in a first position and (2) to prevent the flow of fuel to the first cavity, to permit the flow of fuel to the second cavity and to direct a second gas to said second oxygen depletion sensor nozzle when the controller is in a second position.

2. The heater of claim 1, wherein the fluid flow controller is configured such that in the second position, the second fuel additionally proceeds through the outlet end of the second cavity to exit the nozzle.

3. The heater of claim 1, wherein an axial line through the input end of the first cavity is at an angle with respect to an axial line through the input end of the second cavity.

4. The heater of claim 1, wherein the first cavity and the second cavity comprise a common axis.

5. The heater of claim 1, wherein the first cavity and the second cavity are in substantially airtight engagement with each other.

6. The heater of claim 1, wherein the first cavity and the second cavity are integrally formed of a unitary piece of material.

7. The heater of claim 1, wherein the first cavity and the second cavity are each configured to be engaged by a tightening device such that the first cavity and the second cavity can be rotated in opposite directions about an axis of the heater nozzle.

8. The heater of claim 7 wherein the second cavity comprises a flange that comprises two or more substantially flat surfaces.

9. The heater of claim 1, wherein the first cavity and the second cavity each comprises a substantially hexagonal portion.

10. The heater of claim 5, wherein a cross-sectional area of the output end of the first cavity is larger than a cross-sectional area of the output end of the second cavity.

11. The heater of claim 1, wherein the first fuel proceeds through the output end of the first cavity and the output end of the second cavity to exit the nozzle.

12. The heater of claim 1, wherein at least a portion of the second cavity is within the first cavity.

13. The heater of claim 1, wherein at least a portion of the first cavity and at least a portion of the second cavity are within a sidewall of the heater nozzle.

* * * * *

UNITED STATES PATENT AND TRADEMARK OFFICE

CERTIFICATE OF CORRECTION

PATENT NO. : 7,677,236 B2
APPLICATION NO. : 11/443446
DATED : March 16, 2010
INVENTOR(S) : David Deng It is certified that error appears in the above-identified patent and that said Letters Patent is hereby corrected as shown below:

At column 15, line 9, in Claim 8, delete "claim 7" and insert -- claim 7, --, therefor.

At column 16, line 1, in Claim 10, delete "claim 5," and insert -- claim 1, --, therefor.

Signed and Sealed this

Third Day of August, 2010

David J. Kappos

David J. Kappos
*Director of the United States Patent and Trademark Office*